US011396110B2

(12) United States Patent
Huber et al.

(10) Patent No.: US 11,396,110 B2
(45) Date of Patent: Jul. 26, 2022

(54) SIMULATED BOG-DOWN SYSTEM AND METHOD FOR POWER TOOLS

(71) Applicant: MILWAUKEE ELECTRIC TOOL CORPORATION, Brookfield, WI (US)

(72) Inventors: Alex Huber, Menomonee Falls, WI (US); Murat Avci, Lübeck (DE); Timothy R. Obermann, Waukesha, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 595 days.

(21) Appl. No.: 16/283,143

(22) Filed: Feb. 22, 2019

(65) Prior Publication Data

US 2019/0263015 A1 Aug. 29, 2019

Related U.S. Application Data

(60) Provisional application No. 62/636,633, filed on Feb. 28, 2018.

(51) Int. Cl.
*B27B 5/29* (2006.01)
*B28D 1/04* (2006.01)
(Continued)

(52) U.S. Cl.
CPC ..... *B27B 5/29* (2013.01); *B28D 1/045* (2013.01); *B27B 5/02* (2013.01); *B27B 5/10* (2013.01)

(58) Field of Classification Search
CPC .... B27B 5/29; B27B 5/02; B27B 5/10; B25B 59/001; B25B 21/00; B25B 21/02;
(Continued)

(56) References Cited

U.S. PATENT DOCUMENTS 4,550,277 A 10/1985 Carney
4,574,226 A 3/1986 Binder
(Continued)

FOREIGN PATENT DOCUMENTS

CN 105215953 A 1/2016
ES 1076369 U 2/2012
(Continued)

OTHER PUBLICATIONS

International Search Report and Written Opinion for Application No. PCT/US2019/019217, dated Jun. 14, 2019, 12 pages.
(Continued)

*Primary Examiner* — Chelsea E Stinson
*Assistant Examiner* — Scott A Howell
(74) *Attorney, Agent, or Firm* — Michael Best & Friedrich LLP

(57) ABSTRACT

Simulated bog-down system and method for power tools. One power tool according to an example embodiment includes a power source and a motor selectively coupled to the power source. The motor includes a rotor and stator windings. The power tool includes an actuator configured to generate a drive request signal and a power switching network configured to selectively couple the power source to the stator windings of the motor. The power tool includes an electronic processor coupled to the power source, the actuator, and the power switching network. The electronic processor is configured to detect a load on the power tool and compare the load to a threshold. The electronic processor is configured to determine that the load is greater than the threshold, and to control the power switching network to simulate bog-down in response to determining that the load is greater than the threshold.

20 Claims, 6 Drawing Sheets

(51) Int. Cl.
*B27B 5/02* (2006.01)
*B27B 5/10* (2006.01)

(58) Field of Classification Search
CPC ... B25B 23/1405; B25B 23/1475; B25F 5/00; B25F 5/001; B23D 59/001; B28D 1/045
See application file for complete search history.

(56) References Cited

U.S. PATENT DOCUMENTS 5,014,793 A 5/1991 Germanton et al.
5,410,229 A 4/1995 Sebastian et al.
5,889,922 A 3/1999 Bufe et al.
5,923,145 A 7/1999 Reichard et al.
6,172,860 B1 1/2001 Koshimizu et al.
6,479,958 B1 * 11/2002 Thompson ..... B25F 5/00 318/430
6,495,932 B1 12/2002 Koshimizu et al.
6,771,043 B2 8/2004 Matsunaga et al.
6,873,124 B2 3/2005 Kawano et al.
6,945,330 B2 9/2005 Wilson et al.
7,109,675 B2 9/2006 Matsunaga et al.
7,133,601 B2 11/2006 Phillips et al.
7,152,680 B2 12/2006 Wilson et al.
7,446,493 B2 11/2008 Forster et al.
7,496,460 B2 2/2009 Hornick et al.
7,504,791 B2 3/2009 Sieber et al.
7,521,892 B2 4/2009 Funabashi et al.
7,551,411 B2 6/2009 Woods et al.
7,580,803 B2 8/2009 Hornick et al.
7,681,659 B2 * 3/2010 Zhang ..... B25B 21/00 173/1
7,817,384 B2 10/2010 Woods et al.
8,172,004 B2 5/2012 Ho
8,302,701 B2 11/2012 Morimura et al.
8,505,647 B2 8/2013 Kasuya et al.
8,657,031 B2 2/2014 Kononenko et al.
8,672,807 B2 3/2014 Atsumi et al.
8,803,481 B2 8/2014 Tachikawa et al.
8,881,842 B2 11/2014 Borinato et al.
8,919,456 B2 12/2014 Ng et al.
9,162,331 B2 10/2015 Tang
9,193,055 B2 11/2015 Lim et al.
9,257,925 B2 2/2016 Coates
9,314,855 B2 4/2016 Ookubo et al.
9,325,265 B2 4/2016 Suzuki
9,352,456 B2 5/2016 Murthy et al.
9,537,335 B2 1/2017 Furui et al.
9,543,871 B2 1/2017 Kato
9,577,450 B2 2/2017 Yoshikawa et al.
9,595,839 B2 3/2017 Furui et al.
9,780,583 B2 10/2017 Furui et al.
9,780,718 B2 10/2017 Barfus
2006/0081386 A1 4/2006 Zhang et al.
2007/0000676 A1 * 1/2007 Arimura ..... B25B 23/1475 173/179
2007/0084613 A1 * 4/2007 Zhang ..... B25F 5/001 173/1
2008/0110653 A1 * 5/2008 Zhang ..... H02P 29/032 173/1
2011/0030981 A1 2/2011 Furui et al.
2012/0019177 A1 1/2012 Kaufinann et al.
2012/0163932 A1 6/2012 Schmidt et al.
2013/0020102 A1 1/2013 Bjomlinger et al.
2013/0098646 A1 4/2013 Funabashi et al.
2013/0327552 A1 12/2013 Lovelass et al.
2014/0148808 A1 5/2014 Inkpen et al.
2014/0151079 A1 6/2014 Furui et al.
2014/0158389 A1 6/2014 Ito et al.
2014/0284070 A1 9/2014 Ng et al.
2014/0352995 A1 12/2014 Matsunaga et al.
2014/0371761 A1 12/2014 Juanpera
2015/0041164 A1 2/2015 Sergyeyenko et al.
2015/0352699 A1 12/2015 Sakai et al.
2016/0031072 A1 2/2016 Lim et al.
2017/0008159 A1 1/2017 Boeck et al.
2017/0106520 A1 4/2017 Schadow et al.
2017/0216986 A1 8/2017 Dey, IV et al.
2017/0222579 A1 8/2017 Wang et al.
2018/0323641 A1 11/2018 Lee et al.
2020/0052479 A1 * 2/2020 Friedman ..... H02H 7/20
2020/0086405 A1 3/2020 Ogino

FOREIGN PATENT DOCUMENTS

GB 2485276 A 5/2012
WO 2017174300 A1 10/2017

OTHER PUBLICATIONS

International Search Report and Written Opinion for Application No. PCT/US2019/017443, dated Jun. 27, 2019, 14 pages.
Extended European Search Report for Application No. 19761003.3 dated Oct. 11, 2021 (9 pages).
United States Patent Office Action for U.S. Appl. No. 16/272,182 dated Aug. 10, 2021 (14 pages).
Chinese Patent Office Action for Application No. 201980016175.2 dated Apr. 6, 2022 (11 pages including statement of relevance).

* cited by examiner

SIMULATED BOG-DOWN SYSTEM AND METHOD FOR POWER TOOLS

RELATED APPLICATIONS

This application claims priority to U.S. Provisional Patent Application No. 62/636,633, filed on Feb. 28, 2018, the entire contents of which are hereby incorporated by reference.

FIELD OF THE INVENTION

The present invention relates to simulating bog-down of a power tool during operation.

SUMMARY

Figure 1:
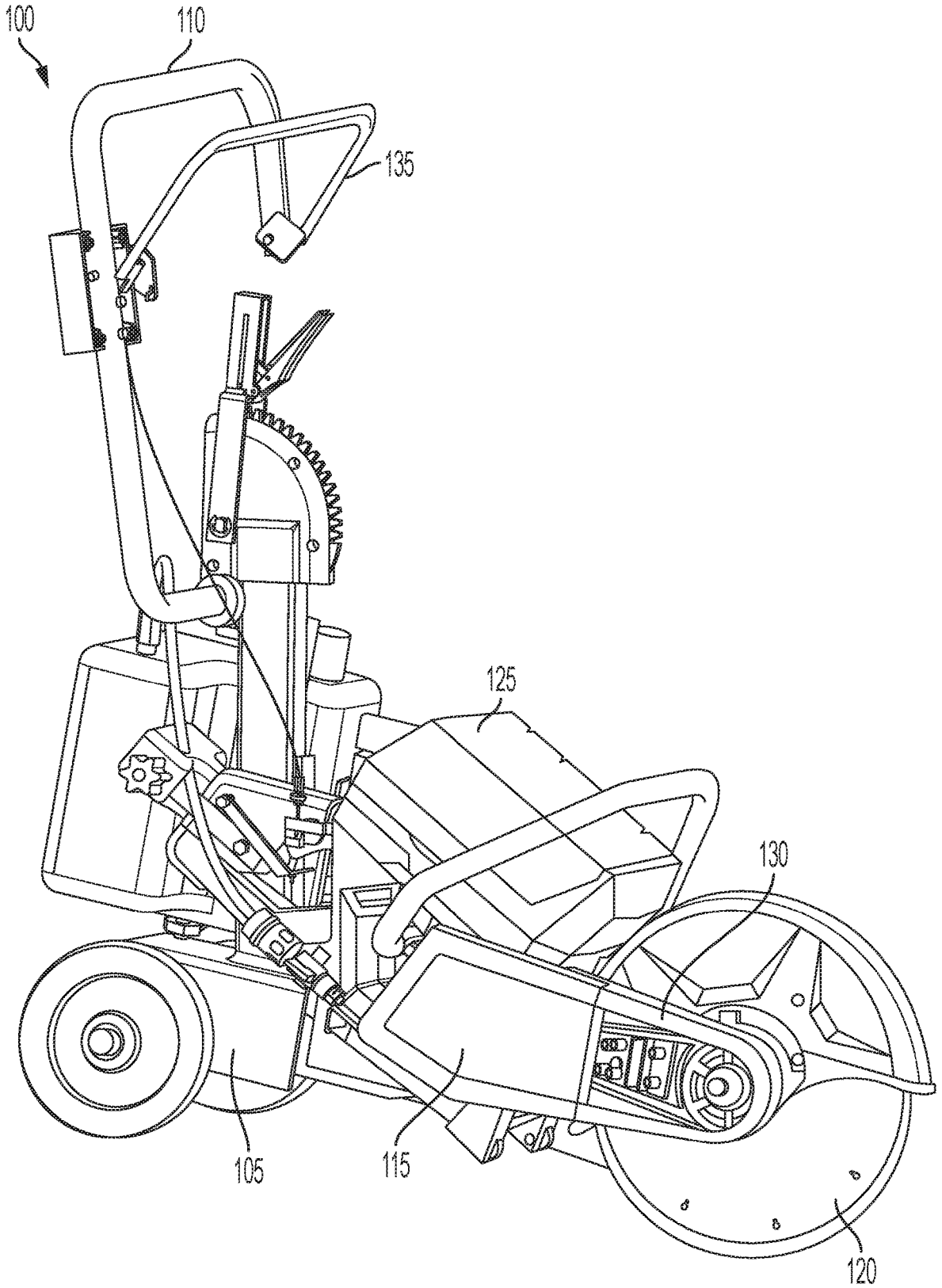
FIG. 1 illustrates a power tool according to one embodiment of the invention.

In one embodiment, a power tool is provided including a power source and a motor selectively coupled to the power source. The motor includes a rotor and stator windings. The power tool further includes an actuator configured to generate a drive request signal and a power switching network configured to selectively couple the power source to the stator windings of the motor. The power tool further includes an electronic processor coupled to the power source, the actuator, and the power switching network. The electronic processor is configured to detect a load on the power tool and compare the load to a threshold. The electronic processor is further configured to determine that the load is greater than the threshold, and to control the power switching network to simulate bog-down in response to determining that the load is greater than the threshold.

In another embodiment, a method of driving a power tool is provided. The method includes detecting, with an electronic processor, a load of the power tool. The power tool includes a motor selectively coupled to a power source, and the motor includes a rotor and stator windings. A power switching network selectively couples the power source to the stator windings of the motor in response to a drive request signal generated by an actuator. The method further includes the electronic processor comparing the load to a threshold, and determining that the load is greater than the threshold. The method also includes controlling, with the electronic processor, the power switching network to simulate bog-down in response to determining that the load is greater than the threshold.

In one embodiment, a power tool is provided including a power source, a motor selectively coupled to the power source, an actuator configured to generate a drive request signal, a power switching network configured to selectively couple the power source to the motor, and an electronic processor. The electronic processor is coupled to the power source, the actuator, and the power switching network. The electronic processor is further configured to detect a load on the power tool, and to receive the drive request signal from the actuator, where the drive request signal corresponds to a first drive speed of the motor. The electronic processor is also configured to generate a current limit signal corresponding to a second drive speed of the motor based on the detected load and a current limit of one of a group consisting of the power source and the power tool. The electronic processor is further configured to compare the drive request signal and the current limit signal, and to determine that the second drive speed of the motor corresponding to the current limit signal is less than the first drive speed of the motor corresponding to the drive request signal based on the comparison. Further, the electronic processor is configured to control the power switching network based on the current limit signal to simulate bog-down in response to determining that the second drive speed of the motor corresponding to the current limit signal is less than the first drive speed of the motor corresponding to the drive request signal.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

It should be noted that a plurality of hardware and software based devices, as well as a plurality of different structural components may be utilized to implement the invention. Furthermore, and as described in subsequent paragraphs, the specific configurations illustrated in the drawings are intended to exemplify embodiments of the invention and that other alternative configurations are possible. The terms "processor" "central processing unit" and "CPU" are interchangeable unless otherwise stated. Where the terms "processor" or "central processing unit" or "CPU" are used as identifying a unit performing specific functions, it should be understood that, unless otherwise stated, those functions can be carried out by a single processor, or multiple processors arranged in any form, including parallel processors, serial processors, tandem processors or cloud processing/cloud computing configurations.

FIG. 1 illustrates a power tool 100. In the illustrated embodiment, the power tool 100 is a concrete saw. In other embodiments, the power tool 100 is another type of power tool such as a jack hammer, a lawn mower, or the like. As indicated by these example power tools, in some embodiments, the power tool 100 is a type of power tool that has been traditionally powered by a gas engine such as a heavy duty power tool that is not typically independently supported by a user during operation. As shown in FIG. 1, the power tool 100 includes a main body 105 that supports a handle 110, a motor housing 115, an output device 120, and a power source 125.

The motor housing 115 supports a motor that actuates the output device 120, also referred to as a tool implement, and allows the output device 120 to perform a particular task. In the illustrated embodiment, rotational motion of the motor is provided to the output device 120 using a belt 130. In other embodiments, particularly with other power tools, the belt 130 may not be present and rotational motion of the motor is provided to the output device 120 in another known manner, such as with a chain drive or a drive shaft. For example, although the output device 120 of FIG. 1 is a circular blade that rotates, in some embodiments, the output device 120 is another type of output device that the motor drives to move in a different manner. For example, in embodiments where the power tool 100 is a jack hammer, the output device 120 is a chisel that moves back and forth along a linear axis. The power source (e.g., a battery pack) 125 couples to the power tool 100 and provides electrical power to energize the motor. The motor is energized based on the position of an input device 135, which is also referred to as an actuator. In some embodiments, the input device 135 is located on the handle 110. When the input device 135 is actuated (i.e., depressed such that it is held close to the handle 110), power is provided to the motor to cause the output device 120 to rotate. When the input device 135 is released as shown in FIG. 1, power is not provided to the motor and, thus, the output device 120 slows and stops if it was previously being driven by the motor.

In the illustrated embodiment, the input device 135 is approximately the same shape as the handle 110. However, in other embodiments, the input device 135 is arranged and/or shaped differently and is positioned elsewhere on the power tool 100 (e.g., the input device 135 may be a trigger configured to be actuated by one or more fingers of the user). In some embodiments, the input device 135 is biased (e.g., with a spring) such that it moves in a direction away from the handle 110 when the input device 135 is released by the user. The input device 135 outputs a drive request signal indicative of its position. In some instances, the drive request signal is binary and indicates either that the input device 135 is depressed or released. In other instances, the drive request signal indicates the position of the input device 135 with more precision. For example, the input device 135 may output an analog drive request signal that varies from 0 to 5 volts depending on the extent that the input device 135 is depressed. For example, 0 V output indicates that the input device 135 is released, 1 V output indicates that the input device 135 is 20% depressed, 2 V output indicates that the input device 135 is 40% depressed, 3 V output indicates that the input device 135 is 60% depressed, 4 V output indicates that the input device 135 is 80% depressed, and 5 V indicates that the input device 135 is 100% depressed. The drive request signal output by the input device 135 may be analog or digital.

In some embodiments, the input device 135 includes a secondary input device that receives a second input from the user that indicates a power level desired by the user. For example, the secondary input may have five power levels corresponding to the five voltage examples above. In such embodiments, the drive request signal from the input device 135 may be binary to indicate whether the input device 135 is depressed or released. However, the secondary input may cause the input device 135 to provide a different drive request signal to control the power tool 100 depending on a setting of the secondary input device. For example, when the secondary input device is set to 60%, the input device 135 provides a 3 V output when the input device 135 is depressed. Similarly, when the secondary input device is set to 100%, the input device 135 provides a 5 V output when the input device 135 is depressed.

Figure 2:
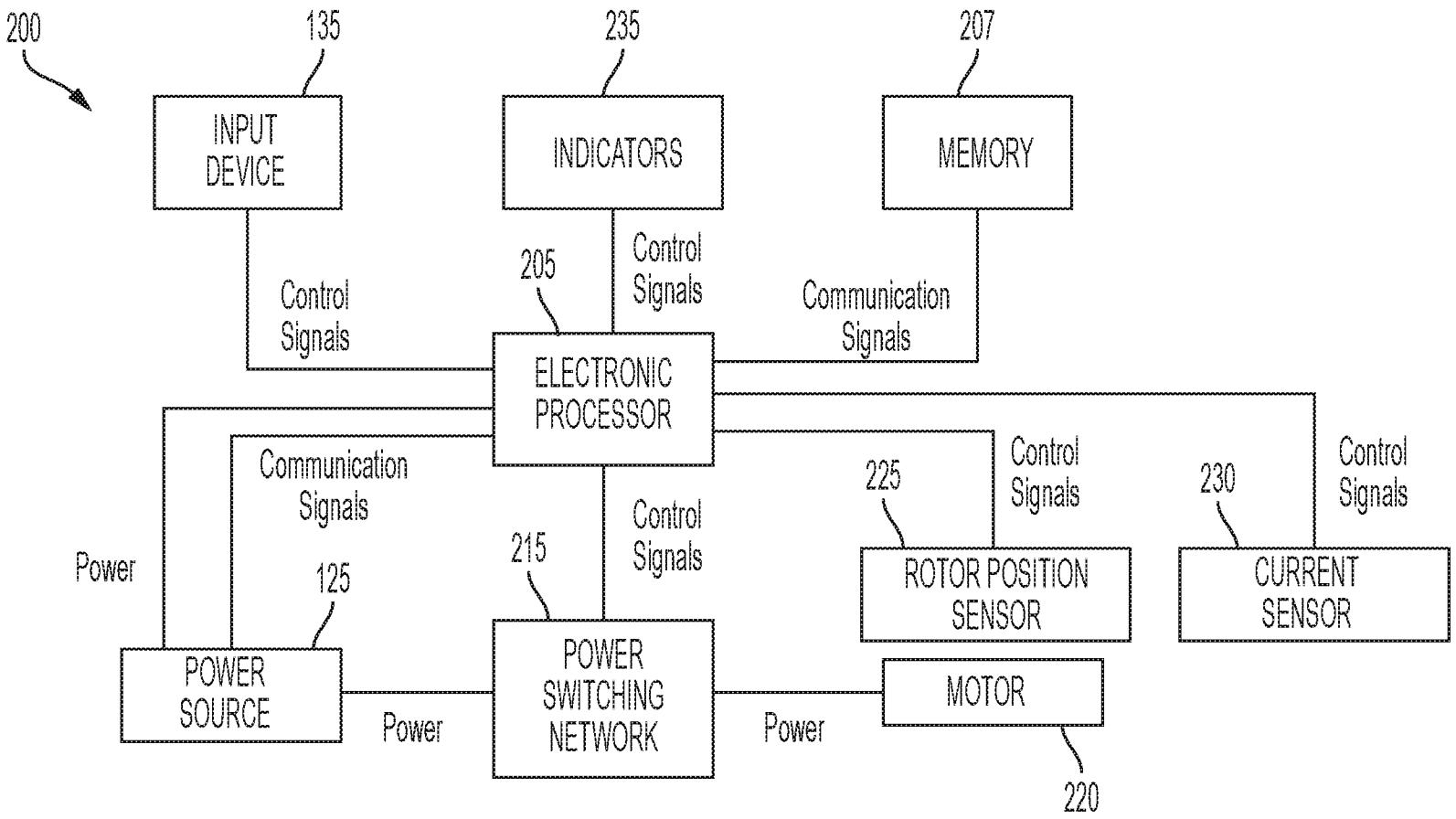
FIG. 2 illustrates a simplified block diagram of the power tool of FIG. 1 according to one embodiment of the invention.

FIG. 2 illustrates a simplified block diagram 200 of the power tool 100 according to one example embodiment. As shown in FIG. 2, the power tool 100 includes an electronic processor 205, a memory 207, the power source (e.g., a battery pack) 125, a power switching network 215, a motor 220, a rotor position sensor 225, a current sensor 230, the input device 135, and indicators (e.g., light-emitting diodes) 235. In some embodiments, the power tool 100 includes fewer or additional components than those shown in FIG. 2. For example, the power tool 100 may include a battery pack fuel gauge, a work lights, additional sensors such as a transducer used for sensing torque of the motor 220 that is indicative of a load on the power tool 100, etc.

As shown in FIG. 2, the power source 125 provides power to the electronic processor 205. In some embodiments, the power source 125 is a power tool battery pack providing a nominal voltage of about 80 volts DC, or another level between about 60-90 volts. For example, the power source 125 includes several battery cells (e.g., lithium ion or another chemistry) electrically connected in series, parallel, or a combination thereof, to generate the desired output voltage. Further, in some embodiments, the power source 125 includes a housing that contains and supports the battery cells, as well as a microprocessor used to control, at least in part, charging and discharging of the power source 125, and operable to communicate with the power tool 100. In some embodiments, the power tool 100 includes active and/or passive components (e.g., voltage step-down controllers, voltage converters, rectifiers, filters, etc.) to regulate or control the power provided by the power source 125 to the other components of the power tool 100 (e.g., the power provided to the electronic processor 205). Additionally, in some embodiments, the electronic processor 205 and the power source 125 are configured to communicate with each other.

The memory 207 includes read only memory (ROM), random access memory (RAM), other non-transitory computer-readable media, or a combination thereof. The electronic processor 205 is configured to communicate with the memory 207 to store data and retrieve stored data. The electronic processor 205 is configured to receive instructions and data from the memory 207 and execute, among other things, the instructions. In particular, the electronic processor 205 executes instructions stored in the memory 207 to perform the methods described herein.

The power switching network 215 enables the electronic processor 205 to control the operation of the motor 220, which may be a brushless direct current (DC) motor in some embodiments. Generally, when the input device 135 is depressed, electrical current is supplied from the power source 125 to the motor 220, via the power switching network 215. When the input device 135 is not depressed, electrical current is not supplied from the power source 125 to the motor 220. In some embodiments, the amount in which the input device 135 is depressed is related to or corresponds to a desired speed of rotation of the motor 220. In other embodiments, the amount in which the input device 135 is depressed is related to or corresponds to a desired torque.

In response to the electronic processor 205 receiving a drive request signal from the input device 135, the electronic processor 205 activates the power switching network 215 to provide power to the motor 220. Through the power switching network 215, the electronic processor 205 controls the amount of current available to the motor 220 and thereby controls the speed and torque output of the motor 220. The power switching network 215 may include numerous field-effect transistors (FETs), bipolar transistors, or other types of electrical switches. For instance, the power switching network 215 may include a six-FET bridge that receives pulse-width modulated (PWM) signals from the electronic processor 205 to drive the motor 220.

The rotor position sensor 225 and the current sensor 230 are coupled to the electronic processor 205 and communicate to the electronic processor 205 various control signals indicative of different parameters of the power tool 100 or the motor 220. In some embodiments, the rotor position sensor 225 includes a Hall sensor or a plurality of Hall sensors. In other embodiments, the rotor position sensor 225 includes a quadrature encoder attached to the motor 220. The rotor position sensor 225 outputs motor feedback information to the electronic processor 205, such as an indication (e.g., a pulse) when a magnet of a rotor of the motor 220 rotates across the face of a Hall sensor. Based on the motor feedback information from the rotor position sensor 225, the electronic processor 205 can determine the position, velocity, and acceleration of the rotor. In response to the motor feedback information and the signals from the input device 135, the electronic processor 205 transmits control signals to control the power switching network 215 to drive the motor 220. For instance, by selectively enabling and disabling the FETs of the power switching network 215, power received from the power source 125 is selectively applied to stator windings of the motor 220 in a cyclic manner to cause rotation of the rotor of the motor. The motor feedback information is used by the electronic processor 205 to ensure proper timing of control signals to the power switching network 215 and, in some instances, to provide closed-loop feedback to control the speed of the motor 220 to be at a desired level. For example, to drive the motor 220, using the motor positioning information from the rotor position sensor 225, the electronic processor 205 determines where the rotor magnets are in relation to the stator windings and (a) energizes a next stator winding pair (or pairs) in the predetermined pattern to provide magnetic force to the rotor magnets in a direct of desired rotation, and (b) de-energizes the previously energized stator winding pair (or pairs) to prevent application of magnetic forces on the rotor magnets that are opposite the direction of rotation of the rotor.

The current sensor 230 monitors or detects a current level of the motor 220 during operation of the power tool 100 and provides control signals to the electronic processor 205 that are indicative of the detected current level. The electronic processor 205 may use the detected current level to control the power switching network 215 as explained in greater detail below. For example, a detected current level of the motor 220 from the current sensor 230 may indicate a load on the power tool 100. In some embodiments, the load on the power tool 100 may be determined in other manners besides detecting the current level of the motor 220. For example, the power tool 100 may include a transducer configured to provide a signal to the electronic processor 205 indicative of a torque level of the motor 220 that indicates the load on the power tool 100.

As shown in FIG. 2, the indicators 235 are also coupled to the electronic processor 205 and receive control signals from the electronic processor 205 to turn on and off or otherwise convey information based on different states of the power tool 100. The indicators 235 include, for example, one or more light-emitting diodes ("LEDs"), or a display screen. The indicators 235 can be configured to display conditions of, or information associated with, the power tool 100. For example, the indicators 235 are configured to indicate measured electrical characteristics of the power tool 100, the status of the power tool 100, the mode of the power tool, etc. The indicators 235 may also include elements to convey information to a user through audible or tactile outputs. In some embodiments, the indicators 235 include an eco-indicator that indicates an amount of power being used by the power tool 100 during operation as will be described in greater detail below (see FIG. 5).

The connections shown between components of the power tool 100 are simplified in FIG. 2. In practice, the wiring of the power tool 100 is more complex, as the components of a power tool are interconnected by several wires for power and control signals. For instance, each FET of the power switching network 215 is separately connected to the electronic processor 205 by a control line; each FET of the power switching network 215 is connected to a terminal of the motor 220; the power line from the power source 125 to the power switching network 215 includes a positive wire and a negative/ground wire; etc. Additionally, the power wires can have a large gauge/diameter to handle increased current. Further, although not shown, additional control signal and power lines are used to interconnect additional components of the power tool 100 (e.g., power is also provided to the memory 207).

Many heavy duty power tools (such as concrete saw, jack hammers, lawn mowers, and the like) are powered by gas engines. During operation of gas engine-powered power tools, an excessive input force exerted on the power tool or a large load encountered by the power tool may cause a resistive force impeding further operation of the power tool. For example, a gas engine-powered concrete saw that is pushed too fast or too hard to cut concrete may have its motor slowed or bogged-down because of the excessive load. This bog-down of the motor can be sensed (e.g., felt and heard) by a user, and is a helpful indication that an excessive input, which may potentially damage the power tool, has been encountered. In contrast, high-powered electric motor driven power tools, similar to the power tool 100, for example, do not innately provide the bog-down feedback to the user. Rather, in these high-powered electric motor driven power tools, excessive loading of the power tool causes the motor to draw excess current from the power source or battery pack. Drawing excess current from the battery pack may cause quick and potentially detrimental depletion of the battery pack.

Figure 3A:
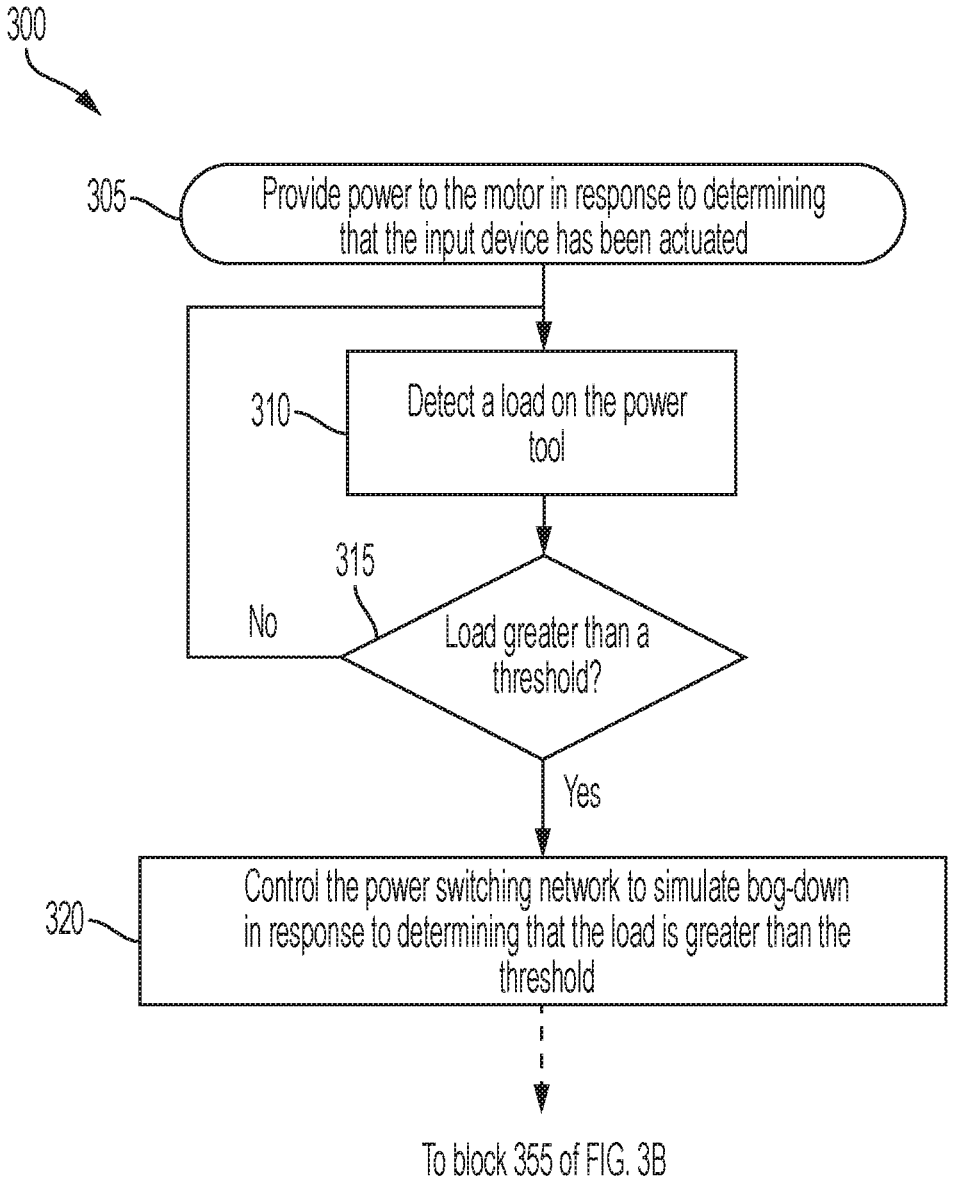
FIGS. 3A-B illustrate flowcharts of a method to provide simulated bog-down operation of the power tool of FIG. 1 according to one embodiment.

Accordingly, in some embodiments, the power tool 100 includes a simulated bog-down feature to provide an indication to the user that excessive loading of the power tool 100 is occurring during operation (e.g., as detected based on current level of the motor 220, a torque level of the motor 220, and/or the like). In some embodiments, the electronic processor 205 executes a method 300 as shown in FIG. 3A to provide simulated bog-down operation of the power tool 100 that is similar to actual bog-down experienced by gas engine-powered power tools.

At block 305, the electronic processor 205 controls the power switching network 215 to provide power to the motor 220 in response to determining that the input device 135 has been actuated. For example, the electronic processor 205 provides a PWM signal to the FETs of the power switching network 215 to drive the motor 220 in accordance with the drive request signal from the input device 135. At block 310, the electronic processor 205 detects a load on the power tool (e.g., using the current sensor 230, a transducer that monitors the torque of the motor 220, and/or the like). At block 315, the electronic processor 205 compares the load to a threshold. When the load is not greater than the threshold, the method 300 proceeds back to block 310 such that the electronic processor 205 repeats blocks 310 and 315 until the load is greater than the threshold.

When the electronic processor 205 determines that the load is greater than the threshold, at block 320, the electronic processor 205 controls the power switching network 215 to simulate bog-down in response to determining that the load is greater than the threshold. In some embodiments, the electronic processor 205 controls the power switching network 215 to decrease the speed of the motor 220 to a non-zero value. For example, the electronic processor 205 reduces a duty cycle of the PWM signal provided to the FETs of the power switching network 215. In some embodiments, the reduction in the duty cycle (i.e., the speed of the motor 220) is proportional to an amount that the load is above the threshold (i.e., an amount of excessive load). In other words, the more excessive the load of the power tool 100, the further the speed of the motor 220 is reduced by the electronic processor 205. For example, in some embodiments, the electronic processor 205 determines, in step 320, the difference between the load of the motor and the load threshold to determine a difference value. Then, the electronic processor 205 determines the amount of reduction in the duty cycle based on the difference value (e.g., using a look-up table).

In some embodiments, at block 320, the electronic processor 205 controls the power switching network 215 in a different or additional manner to provide an indication to the user that excessive loading of the power tool 100 is occurring during operation. In such embodiments, the behavior of the motor 220 may provide a more noticeable indication to the user that excessive loading of the power tool 100 is occurring than the simulated bog-down described above. As one example, the electronic processor 205 controls the power switching network 215 to oscillate between different motor speeds. Such motor control may be similar to a gas engine-powered power tool stalling and may provide haptic feedback to the user to indicate that excessive loading of the power tool 100 is occurring. In some embodiments, the electronic processor 205 controls the power switching network 215 to oscillate between different motor speeds to provide an indication to the user that very excessive loading of the power tool 100 is occurring. For example, the electronic processor 205 controls the power switching network 215 to oscillate between different motor speeds in response to determining that the load of the power tool 100 is greater than a second threshold that is greater than the threshold described above with respect to simulated bog-down. As another example, the electronic processor 205 controls the power switching network 215 to oscillate between different motor speeds in response to determining that the load of the power tool 100 has been greater than the threshold described above with respect to simulated bog-down for a predetermined time period (e.g., two seconds). In other words, the electronic processor 205 may control the power switching network 215 to simulate bog-down when excessive loading of the power tool 100 is detected and may control the power switching network 215 to simulate stalling when excessive loading is prolonged or increases beyond a second threshold.

With respect to any of the embodiments described above with respect to block 320, other characteristics of the power tool 100 and the motor 220 may provide indications to the user that excessive loading of the power tool 100 is occurring (e.g., tool vibration, resonant sound of a shaft of the motor 220, and sound of the motor 220). In some embodiments, these characteristics change as the electronic processor 205 controls the power switching network 215 to simulate bog-down or to oscillate between different motor speeds as described above.

Figure 3B:
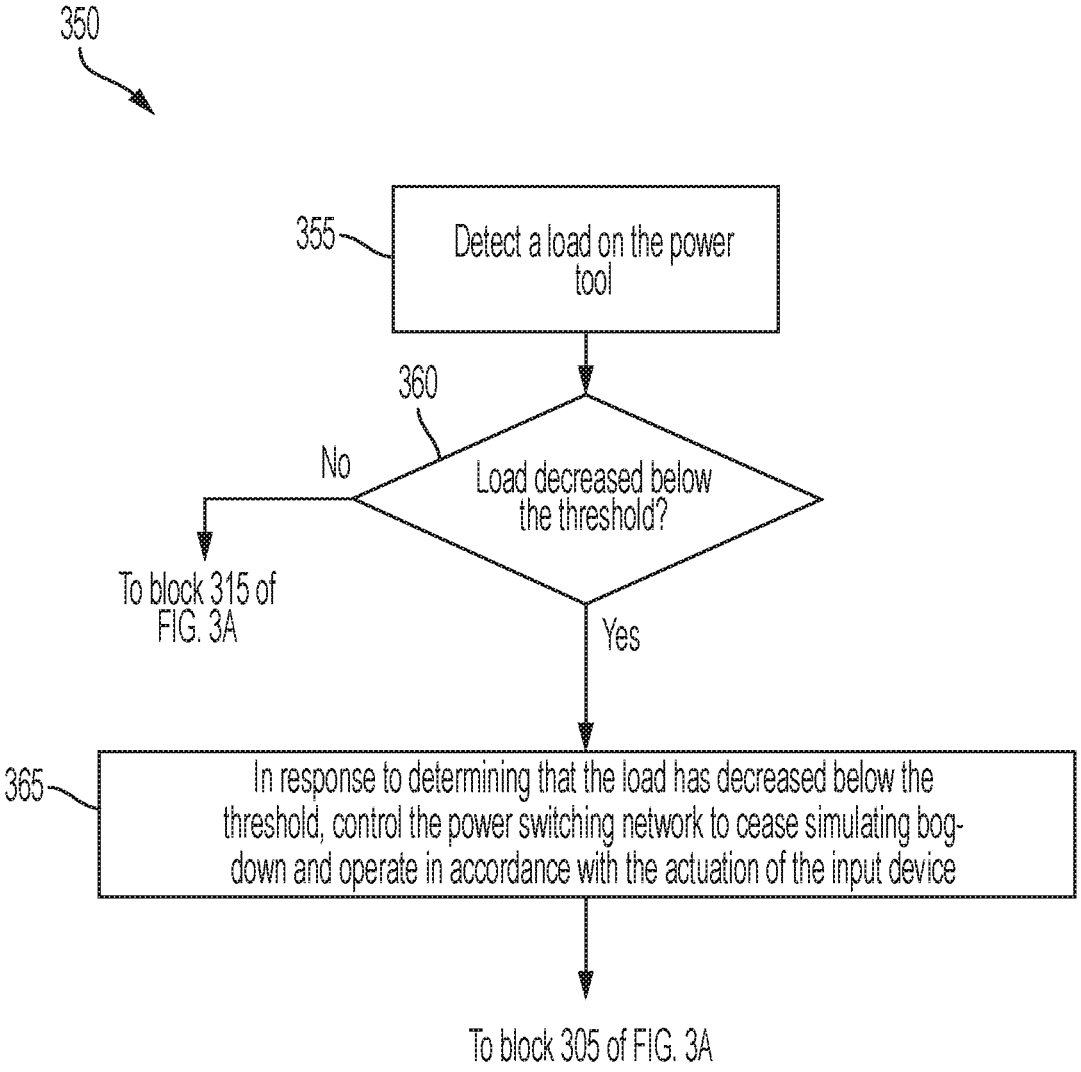

In some embodiments, after the electronic processor 205 controls the power switching network 215 to simulate bog-down (at block 320), the electronic processor 205 executes a method 350 as shown in FIG. 3B. At block 355, which is similar to block 310, the electronic processor 205 detects the load on the power tool 100. At block 360, the electronic processor 205 compares the load on the power tool to the threshold. When the load remains above the threshold, the method 300 proceeds back to block 315 such that the electronic processor 205 repeats blocks 315 through 360 until the load decreases below the threshold. In other words, the electronic processor 205 continues to simulate bog-down until the load decreases below the threshold. Repetition of blocks 315 through 360 allows the electronic processor 205 to simulate bog-down differently as the load changes but remains above the threshold (e.g., as mentioned previously regarding proportional adjustment of the duty cycle of the PWM provided to the FETs).

When the load on the power tool 100 decreases below the threshold (e.g., in response to the user pulling the power tool 100 away from a work surface), the electronic processor 205 controls the power switching network 215 to cease simulating bog-down and operate in accordance with the actuation of the input device 135 (i.e., in accordance with the drive request signal from the input device 135). In other words, the electronic processor 205 controls the power switching network 215 to increase the speed of the motor 220 from the reduced simulated bog-down speed to a speed corresponding to the drive request signal from the input device 135. For example, the electronic processor 205 increases the duty cycle of the PWM signal provided to the FETs of the power switching network 215. In some embodiments, the electronic processor 205 gradually ramps the speed of the motor 220 up from the reduced simulated bog-down speed to the speed corresponding to the drive request signal from the input device 135. Then the method 350 proceeds back to block 305 to allow the electronic processor 205 to continue to monitor the power tool 100 for excessive load conditions. Although not shown in FIGS. 3A and 3B, as indicated by the above description of the input device 135, during execution of any block in the methods 300 and 350, the electronic processor 205 may cease providing power to the motor 220 in response to determining that the input device 135 is no longer actuated (i.e., has been released by the user) or may provide power to the motor 220 to cause the motor 220 to stop rotating (i.e., braking).

Figure 4:
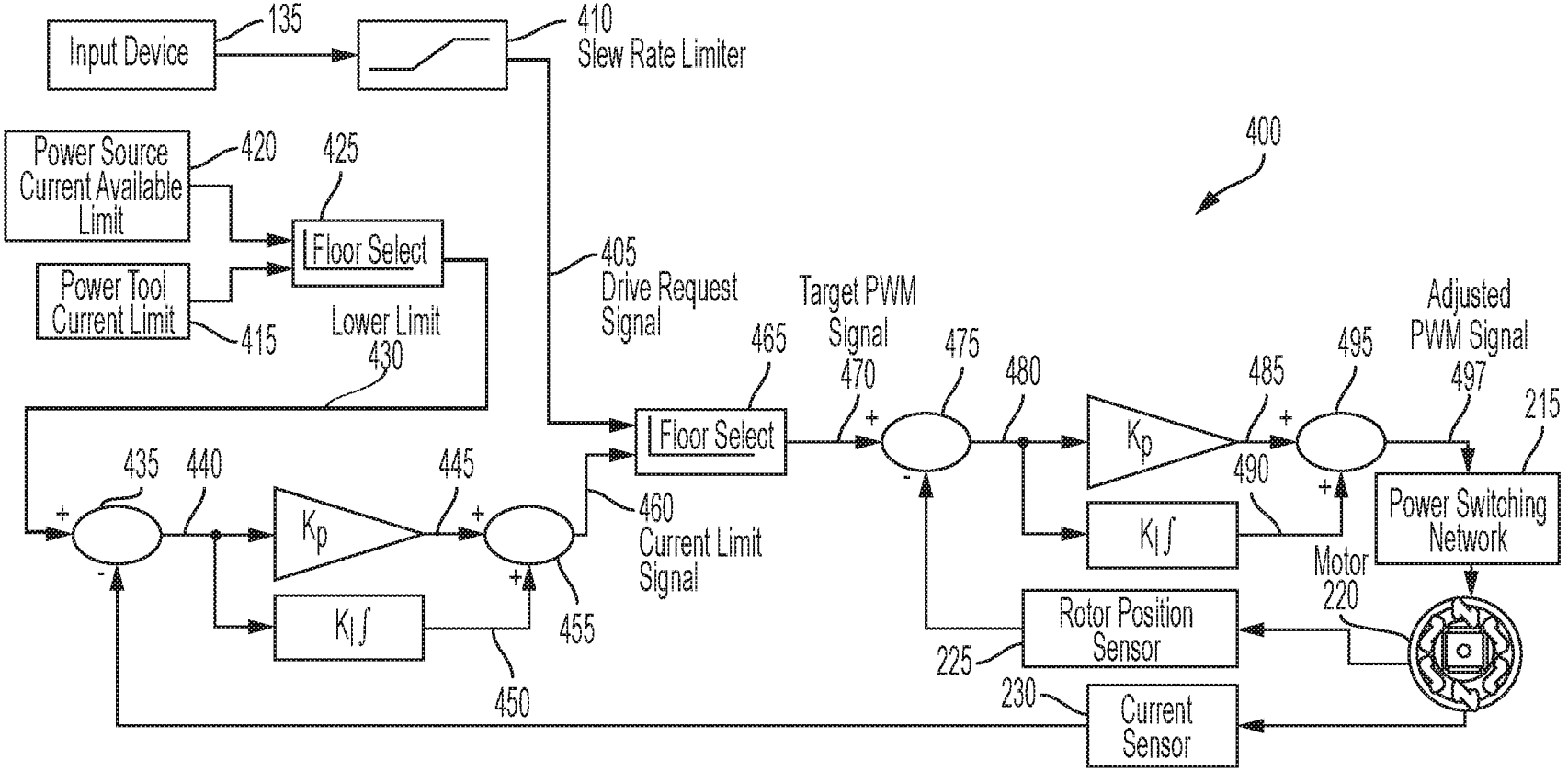
FIG. 4 illustrates a schematic diagram of the power tool of FIG. 1 that shows how an electronic processor of the power tool implements the methods of FIGS. 3A and 3B according to one embodiment.

FIG. 4 illustrates a schematic control diagram 400 of the power tool 100 that shows how the electronic processor 205 implements the methods 300 and 350 according to one example embodiment. In general, the electronic processor 205 receives numerous inputs, makes determinations based on the inputs, and controls the power switching network 215 based on the inputs and determinations. As shown in FIG. 4, the electronic processor 205 receives a drive request signal 405 from the input device 135 as explained previously herein. In some embodiments, the power tool 100 includes a slew rate limiter 410 to condition the drive request signal 405 before the drive request signal 405 is provided to the electronic processor 205. The drive request signal 405 corresponds to a first drive speed of the motor 220 (i.e., a desired speed of the motor 220 based on an amount of depression of the input device 135 or based on the setting of the secondary input device). In some embodiments, the drive request signal 405 is a desired duty ratio (e.g., a value between 0-100%) of the PWM signal for controlling the power switching network 215.

The electronic processor 205 also receives a power tool current limit 415 and a power source current available limit 420. The power tool current limit 415 is a predetermined current limit that is, for example, stored in and obtained from the memory 207. The power tool current limit 415 indicates a maximum current level that can be drawn by the power tool 100 from the power source 125. In some embodiments, the power tool current limit 415 is stored in the memory 207 during manufacturing of the power tool 100. The power source current available limit 420 is a current limit provided by the power source (e.g., battery pack) 125 to the electronic processor 205. The power source current available limit 420 indicates a maximum current that the power source 125 is capable of providing to the power tool 100. In some embodiments, the power source current available limit 420 changes during operation of the power tool 100. For example, as the power source 125 becomes depleted, the maximum current that the power source 125 is capable of providing decreases, and accordingly, as does the power source current available limit 420. In other words, the power source current available limit 420 may change based on the state of charge of the power source 125. The power source current available limit 420 may also be different depending on the temperature of the power source 125 and/or the type of power source 125 (e.g., different types of battery packs). In some embodiments, circuitry within the power source 125 (e.g., a battery pack microcontroller) may determine the power source current available limit 420 and provide the limit 420 to the electronic processor 205 of the power tool 100, for example, via a communication terminal of a battery pack interface. In other embodiments, the electronic processor 205 of the power tool 100 may adjust the power source current available limit 420 of the power source 125 based on one of the characteristics described above (e.g., based on state of charge of the power source 125, temperature of the power source 125, a type of the power source 125, etc.). For example, the electronic processor 205 may use a look-up table that includes power source current available limits 420 for different power sources 125 with various states of charge and temperatures. Although the limits 415 and 420 are described as maximum current levels for the power tool 100 and power source 125, in some embodiments, these are firmware-coded suggested maximums or rated values that are, in practice, lower than true maximum levels of these devices.

As indicated by floor select block 425 in FIG. 4, the electronic processor 205 compares the power tool current limit 415 and the power source current available limit 420 and determines a lower limit 430 using the lower of the two signals 415 and 420. In other words, the electronic processor 205 determines which of the two signals 415 and 420 is lower, and then uses that lower signal as the lower limit 430. The electronic processor 205 also receives a detected current level of the motor 220 from the current sensor 230. At node 435 of the schematic diagram 400, the electronic processor 205 determines an error (i.e., a difference) 440 between the detected current level of the motor 220 and the lower limit 430. Although FIG. 4 illustrates the current sensor 230, the current sensor 230 is representative of a sensor that detects a load on the power tool 100 and provides feedback to the node 435. In some embodiments, the current sensor 230 of FIG. 4 may be any type of load sensor that detects the load on the power tool 100 (e.g., a transducer that detects motor torque, or the like). After the electronic processor 205 determines an error (i.e., a difference) 440 between the detected current level of the motor 220 and the lower limit 430, the electronic processor 205 then applies a proportional gain to the error 440 to generate a proportional component 445. The electronic processor 205 also calculates an integral of the error 440 to generate an integral component 450. At node 455, the electronic processor 205 combines the proportional component 445 and the integral component 450 to generate a current limit signal 460. The current limit signal 460 corresponds to a drive speed of the motor 220 (i.e., a second drive speed) that is based on the detected current level of the motor 220 (or the detected load on the power tool 100 as determined by a different load sensor) and one of the power tool current limit 415 and the power source current available limit 420 (whichever of the two limits 415 and 420 is lower). In some embodiments, the current limit signal 460 is in the form of a duty ratio (e.g., a value between 0-100%) for the PWM signal for controlling the power switching network 215.

As indicated by floor select block 465 in FIG. 4, the electronic processor 205 compares the current limit signal 460 and the drive request signal 405 and determines a target PWM signal 470 using the lower of the two signals 460 and 405. In other words, the electronic processor 205 determines which of the first drive speed of the motor 220 corresponding to the drive request signal 405 and the second drive speed of the motor 220 corresponding to the current limit signal 460 is less. The electronic processor 205 then uses the signal 405 or 460 corresponding to the lowest drive speed of the motor 220 to generate the target PWM signal 470. By selecting the lowest of the drive request signal 405 and the current limit signal 460, the floor select block 465 ensures that the target PWM signal 470 will not result in a drive current that is greater than the lowest current limit of either the power source 125 or the power tool 100.

The electronic processor 205 also receives a measured rotational speed of the motor 220, for example, from the rotor position sensor 225. At node 475 of the schematic diagram 400, the electronic processor 205 determines an error (i.e., a difference) 480 between the measured speed of the motor 220 and a speed corresponding to the target PWM signal 470. The electronic processor 205 then applies a proportional gain to the error 480 to generate a proportional component 485. The electronic processor 205 also calculates an integral of the error 480 to generate an integral component 490. At node 495, the electronic processor 205 combines the proportional component 485 and the integral component 490 to generate an adjusted PWM signal 497 that is provided to the power switching network 215 to control the speed of the motor 220. The components of the schematic diagram 400 implemented by the electronic processor 205 as explained above allow the electronic processor 205 to provide simulated bog-down operation of the power tool 100 that is similar to actual bog-down experienced by gas engine-powered power tools. In other words, in some embodiments, by adjusting the PWM signal 497 in accordance with the schematic control diagram 400, the power tool 100 lowers and raises the motor speed in accordance with the load on the power tool 100, which is perceived by the user audibly and tactilely, to thereby simulate bog down.

Figure 5:
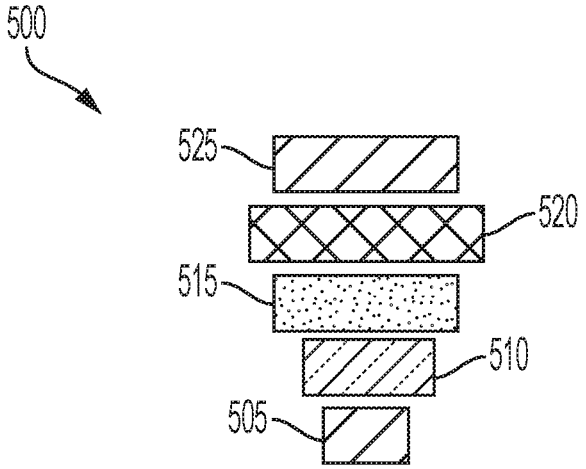
FIG. 5 illustrates an eco-indicator that is included on a housing of the power tool according to one embodiment.

FIG. 5 illustrates an eco-indicator 500 that is included the power tool 100 (e.g., on the handle 110, the motor housing 105, or another location) according to one example embodiment. As mentioned above, the eco-indicator 500 indicates an amount of power being used by the power tool 100 during operation (i.e., an amount of current being drawn from the power source (e.g., battery pack) 125). In the illustrated embodiment, the eco-indicator 500 includes five LED bars 505, 510, 515, 520, and 525. In some embodiments, when the power being used by the power tool 100 exceeds 20% of a maximum power (e.g., based on the power tool current limit 415, the power source current available limit 420, or the like), the electronic processor 205 controls the LED bar 505 to illuminate. For each additional 20% of the maximum power that the power being used by the power tool 100 increases, the electronic processor 205 illuminates an additional LED bar 510 through 525. In other words, at less than 20% maximum power, no LEDs are illuminated; between 20-39%, LED bar 505 is illuminated; between 40-59%, LED bars 505-510 are illuminated; between 60-79%, LED bars 505-515 are illuminated; between 80-99%, LED bars 505-520 are illuminated; and at 100%, LED bars 505-525 are illuminated.

Accordingly, in addition to providing simulated bog-down as described above with respect to FIGS. 3A, 3B, and 4, the eco-indicator 500 provides a visual indication to the user when the power tool 100 becomes bogged down and draws excess current from the power source 125. In some embodiments, the eco-indicator 500 includes LED bars of different colors (e.g., from green at LED bar 505 to red at LED bar 525). In some embodiments, one or more LED bars 505 through 525 blink when the power being used by the power tool 100 exceeds a predetermined limit. In some embodiments, the eco-indicator 500 provides audible or tactile outputs to the user to indicate the amount of power being used by the power tool 100 during operation.

Thus, the invention provides, among other things, a high-powered electric motor driven power tool that provides simulated bog-down operation of the power tool that is similar to actual bog-down experienced by gas engine-powered power tools.

We claim:

1. A power tool comprising:
- a power source;
- a motor selectively coupled to the power source;
- an actuator configured to generate a drive request signal;
- a power switching network configured to selectively couple the power source to the motor; and
- an electronic processor coupled to the power source, the actuator, and the power switching network, the electronic processor configured to:
  - detect a load on the power tool,
  - receive the drive request signal from the actuator, the drive request signal corresponding to a first drive speed of the motor,
  - generate a current limit signal corresponding to a second drive speed of the motor based on the detected load and a current limit of one of a group consisting of the power source and the power tool,
  - compare the drive request signal and the current limit signal,
  - determine that the second drive speed of the motor corresponding to the current limit signal is less than the first drive speed of the motor corresponding to the drive request signal based on the comparison, and
  - control the power switching network based on the current limit signal to simulate bog-down in response to determining that the second drive speed of the motor corresponding to the current limit signal is less than the first drive speed of the motor corresponding to the drive request signal.

2. The power tool of claim 1, wherein the electronic processor is configured to:
- continue to compare the drive request signal and the current limit signal;
- determine that the first drive speed of the motor corresponding to the drive request signal is less than the second drive speed of the motor corresponding to the current limit signal based on the continued comparison; and
- control the power switching network to cease simulating bog-down and based on the drive request signal in response to determining that the first drive speed of the motor corresponding to the drive request signal is less than the second drive speed of the motor corresponding to the current limit signal based on the continued comparison.

3. The power tool of claim 1, wherein the electronic processor is configured to generate the current limit signal at least in part by determining which of a power tool current limit and a power source current available limit is lower;
- wherein the power source current available limit changes based on at least one of a state of charge of the power source and a temperature of the power source.

4. The power tool of claim 1, wherein the electronic processor is configured to detect the load on the power tool by detecting a current level of the motor.

5. A power tool comprising:
- a power source;
- a motor selectively coupled to the power source, the motor including a rotor and stator windings;
- an actuator configured to generate a drive request signal;
- a power switching network configured to selectively couple the power source to the stator windings of the motor; and
- an electronic processor coupled to the power source, the actuator, and the power switching network, the electronic processor configured to:
  - detect a load on the power tool,
  - compare the load to a threshold,
  - determine that the load is greater than the threshold, and
  - control the power switching network to simulate bog-down in response to determining that the load is greater than the threshold,
- wherein the electronic processor is configured to determine the threshold by determining which of a power tool current limit and a power source current available limit is lower.

6. The power tool of claim 5, wherein the drive request signal indicates a desired speed of the motor based on an amount in which the actuator is depressed; and
- wherein the electronic processor is configured to control the power switching network to simulate bog-down by decreasing a speed of the motor to a non-zero value that is less than the desired speed of the motor.

7. The power tool of claim 6, wherein the electronic processor is configured to decrease the speed of the motor in proportion to an amount that the load is above the threshold.

8. The power tool of claim 5, wherein the electronic processor is configured to:
- determine that the load is greater than a second threshold that is greater than the first threshold, and
- control the power switching network to simulate stalling in response to determining that the load is greater than the second threshold, wherein the electronic processor is configured to control the power switching network to simulate stalling by controlling the power switching network to oscillate between different motor speeds to provide haptic feedback to a user of the power tool.

9. The power tool of claim 5, wherein the electronic processor is configured to:

determine that the load has been greater than the threshold for a predetermined time period, and control the power switching network to simulate stalling in response to determining that the load has been greater than the threshold for the predetermined time period, wherein the electronic processor is configured to control the power switching network to simulate stalling by controlling the power switching network to oscillate between different motor speeds to provide haptic feedback to a user of the power tool.

10. The power tool of claim 5, wherein the electronic processor is configured to:

continue to monitor the load and control the power switching network to simulate bog-down;

determine that the load has decreased to be less than the threshold; and in response to determining that the load has decreased to be less than the threshold, control the power switching network to cease simulating bog-down and operate in accordance with the drive request signal generated by the actuator.

11. The power tool of claim 5, wherein the power source current available limit changes based on at least one of a state of charge of the power source and a temperature of the power source.

12. The power tool of claim 5, wherein the electronic processor is configured to detect the load on the power tool by detecting a current level of the motor.

13. A method of driving a power tool, the method comprising:

detecting, with an electronic processor, a load on the power tool, the power tool including a motor selectively coupled to a power source and including a rotor and stator windings, wherein a power switching network selectively couples the power source to the stator windings of the motor in response to a drive request signal generated by an actuator;

determining, with the electronic processor, a threshold by determining which of a power tool current limit and a power source current available limit is lower;

comparing, with the electronic processor, the load to the threshold;

determining, with the electronic processor, that the load is greater than the threshold; and controlling, with the electronic processor, the power switching network to simulate bog-down in response to determining that the load is greater than the threshold.

14. The method of claim 13, wherein the drive request signal indicates a desired speed of the motor based on an amount in which the actuator is depressed, and further comprising:

controlling, with the electronic processor, the power switching network to simulate bog-down by decreasing a speed of the motor to a non-zero value that is less than the desired speed of the motor.

15. The method of claim 14, wherein controlling the power switching network to simulate bog-down by decreasing the speed of the motor to the non-zero value that is less than the desired speed of the motor includes decreasing the speed of the motor in proportion to an amount that the load is above the threshold.

16. The method of claim 13 further comprising:

determining, with the electronic processor, that the load is greater than a second threshold that is greater than the first threshold, and controlling, with the electronic processor, the power switching network to simulate stalling in response to determining that the load is greater than the second threshold, wherein controlling the power switching network to simulate stalling includes controlling, with the electronic processor, the power switching network to oscillate between different motor speeds to provide haptic feedback to a user of the power tool.

17. The method of claim 13 further comprising:

determining, with the electronic processor, that the load has been greater than the threshold for a predetermined time period, and controlling, with the electronic processor, the power switching network to simulate stalling in response to determining that the load has been greater than the threshold for the predetermined time period, wherein controlling the power switching network to simulate stalling includes controlling, with the electronic processor, the power switching network to oscillate between different motor speeds to provide haptic feedback to a user of the power tool.

18. The method of claim 13, further comprising:

continuing to monitor the load and control the power switching network to simulate bog-down with the electronic processor;

determining, with the electronic processor, that the load has decreased to be less than the threshold; and in response to determining that the load has decreased to be less than the threshold, controlling, with the electronic processor, the power switching network to cease simulating bog-down and operate in accordance with the drive request signal generated by the actuator.

19. The method of claim 13, wherein the power source current available limit changes based on at least one of a state of charge of the power source and a temperature of the power source.

20. The method of claim 13, wherein detecting the load on the power tool includes detecting, with the electronic processor, a current level of the motor.

* * * * *